US008707984B2

(12) United States Patent
Lundgren

(10) Patent No.: US 8,707,984 B2
(45) Date of Patent: Apr. 29, 2014

(54) VALVE FASTENING MEANS

(75) Inventor: Bertil Lundgren, Bjartra (SE)

(73) Assignee: Nordhydraulic AB, Kramfors (SE)

( * ) Notice: Subject to any disclaimer, the term of this patent is extended or adjusted under 35 U.S.C. 154(b) by 662 days.

(21) Appl. No.: 12/989,791

(22) PCT Filed: Jun. 22, 2009

(86) PCT No.: PCT/SE2009/050782
§ 371 (c)(1),
(2), (4) Date: Oct. 27, 2010

(87) PCT Pub. No.: WO2010/005370
PCT Pub. Date: Jan. 14, 2010

(65) Prior Publication Data

US 2011/0036419 A1 Feb. 17, 2011

(30) Foreign Application Priority Data

Jul. 7, 2008 (SE) ..... 0801630

(51) Int. Cl.
*F16B 1/00* (2006.01)
*E02F 9/22* (2006.01)

(52) U.S. Cl.
USPC ..... 137/354; 248/298.1; 248/300

(58) Field of Classification Search
USPC ..... 137/899, 351, 899.1, 343, 354; 248/274.1, 279.1, 299.1, 200, 300, 248/307, 298.1
See application file for complete search history.

(56) References Cited

U.S. PATENT DOCUMENTS

| | | | | |
|---|---|---|---|---|
| 1,600,794 | A * | 9/1926 | Brown | 248/300 |
| 1,600,859 | A * | 9/1926 | Wright | 248/300 |
| 1,652,127 | A * | 12/1927 | Harbert | 248/300 |
| 1,705,488 | A * | 3/1929 | Mathews | 248/297.21 |
| 1,716,940 | A * | 6/1929 | Woller | 248/300 |
| 2,261,357 | A | 11/1941 | Fuller | |
| 3,309,053 | A * | 3/1967 | Baker | 248/210 |
| 3,946,977 | A * | 3/1976 | Kuhfus | 379/435 |
| 4,096,878 | A * | 6/1978 | Adams et al. | 137/351 |
| 4,349,046 | A * | 9/1982 | Klem | 137/899 |
| 4,671,726 | A * | 6/1987 | Thuen | 414/182 |
| 5,082,217 | A | 1/1992 | Parker et al. | |
| 5,788,198 | A | 8/1998 | Sharpe | |
| 6,378,825 | B1 | 4/2002 | Yee et al. | |
| 6,935,883 | B2 * | 8/2005 | Oddsen, Jr. | 439/374 |
| 2009/0152423 | A1 * | 6/2009 | Dubinskiy et al. | 248/274.1 |

OTHER PUBLICATIONS

International Search Report, dated Oct. 7, 2009, from corresponding PCT application.

* cited by examiner

*Primary Examiner* — Craig Schneider
*Assistant Examiner* — Jonathan Waddy
(74) *Attorney, Agent, or Firm* — Young & Thompson

(57) ABSTRACT

A valve fastening element (1) for attaching a hydraulic valve (2) to a tractor (13). The valve fastening element (1) includes a tractor part (1*a*) adapted to be attached on the tractor and a valve part (1*b* adapted for direct assembly of the valve (2), wherein the valve (2) includes at least two screw holes (10, 11,12), each adapted to receive a screw (3,4,5). The valve part (1*b*) of the valve fastening element (1) includes at least two slits (6,7,8), of which at least a first slit (6,8) includes an opening (6*a*,8*a*) adapted to let the head of the screw pass, and all slits include a groove (6*b*,7,8*b*,8*c*) that is sufficiently narrow to prevent the head of the screw (3,4,5) from passing but sufficiently wide to allow the thread of the screw (3,4,5) to pass.

20 Claims, 2 Drawing Sheets

VALVE FASTENING MEANS

TECHNICAL FIELD OF THE INVENTION

The present invention relates to valve fastening means and in particular to a valve fastening means for attaching a hydraulic valve to a tractor with a front end loader.

BACKGROUND OF THE INVENTION

Tractors with front end loaders and any associated tools that are operated hydraulically usually include a valve arranged at the attachment point of the front end loader on the tractor or on a foundation on the tractor. This valve connects the hydraulics of the tractor with the hydraulics of the front end loader.

Conventional valves include a number of screw holes, which enables attachment to an attachment plate that is mounted on a custom made fastening means on the tractor. One problem is that the valve is relatively heavy and that it is coupled to relatively stiff hydraulic hoses, which contribute to make it difficult to handle and difficult to mount.

SUMMARY OF THE INVENTION

In view of the foregoing one object with the present invention is to provide a valve fastening means that simplifies engaging and disengaging of a valve on a tractor with a front end loader. Another object is to provide a valve fastening means that is cheaper than conventional ones.

A common idea of the invention is that it should be possible in a first step to attach the valve fastening means, in a second step to adjust the position of it, and in a third step to lock it in place, and that one person readily can perform all the steps without any help from another person.

This may be accomplished with the valve fastening means according to the invention as defined in the dependent claims.

According to a first aspect of the invention the invention relates to a valve fastening means for attaching a hydraulic valve to a tractor. The valve fastening means comprises a tractor part adapted to be attached to a tractor and a valve part adapted for direct assembly of the valve, wherein the valve comprises at least two screw holes, each adapted to receive a screw. The valve part of the valve fastening means comprises at least two slits, of which at least a first slit comprises an opening adapted to let the head of the screw pass, and all the slits each comprises a groove that is sufficiently narrow to prevent the head of the screw pass from passing but sufficiently wide to allow the thread of the screw to pass.

In a preferred embodiment the valve fastening means comprises three slits, of which at least two slits each comprises an opening adapted to let the head of the screw pass, and of which all slits each comprises a groove that is sufficiently narrow to prevent the head of the screw pass from passing but sufficiently wide to allow the thread of the screw to pass.

In another preferred embodiment the grooves are parallel to each other so that the valve, when mounted in the valve fastening means without having the screws fully tightened, can be moved along the grooves in such way that the screws are moved in their respective groove.

Preferably one of the slits does not have any opening for letting the head of the screw pass and optionally this slit is displaced from the slits with an opening and from the position of the screw holes on the valve, whereby the screw that is extending through the slit that does not have any opening has to be screw out in order to enable movement of the valve to a position where the screws, which are extending through the slits that have an opening, are positioned just in front of these openings.

In yet another preferred embodiment the valve part comprises three slits. A first slit and a second slit are arranged one after the other in a common horizontal line, and a third slit is arranged in parallel, but vertically displaced in relation to the other two slits. Each of the first slit and the third slit comprises an opening adapted to let the head of the screw pass and a first groove that is sufficiently narrow to prevent the head of the screw from passing but sufficiently wide to allow the thread of the screw to pass and that extends in parallel and in the same direction in relation to their respective opening, and wherein the second slit comprises a groove but not an opening.

Preferably the third slit comprises a second groove that extends in parallel but in opposite direction from the opening of the slit in relation to the first slit.

In yet another preferred embodiment the slits are arranged relative each other in such way that the valve fastening means can be attached to the tractor in two different orientations, of which one is upside-down in relation to the other, whereby the valve can be arranged properly oriented on the valve fastening means irrespective of the orientation of the valve fastening means on the tractor.

Preferably the tractor part and the valve part are arranged at an angle to each other.

One advantage of the present invention over conventional valve fastening means is that no attachment plate is required. Previously, as described above, the valve has been attached to an attachment plate and thereafter the attachment plate has been attached to an holder intended for this purpose. Thanks to the invention the valve fastening means can be attached to the tractor, and the valve can in a simple and reliable way be attached directly to the valve fastening means.

Embodiments of the invention are defined in the dependent claims. Other objects, advantages and novel features of the invention will become apparent from the following detailed description of the invention when considered in conjunction with the accompanying drawings and claims.

BRIEF DESCRIPTION OF THE DRAWINGS

Preferred embodiments of the invention will now be described with reference to the accompanying drawings, wherein FIG. 1 schematically illustrates a valve fastening means according to the invention, to which a valve is attached, FIGS. 1-6 schematically illustrate the process from the situation when a valve is threaded on to the valve fastening means until the situation when the valve is attached to the valve fastening means, FIGS. 7-10 schematically illustrate a valve that is attached to a valve fastening means according to a second embodiment of the invention, FIGS. 11-14 schematically illustrate a valve that is attached to a valve fastening means according to the second embodiment, wherein the valve fastening means is turned upside-down with regards to FIGS. 7-10, and FIG. 15 schematically illustrates a perspective view of a tractor with a front end loader and an attached valve.

DETAILED DESCRIPTION OF EMBODIMENTS

Figure 15:
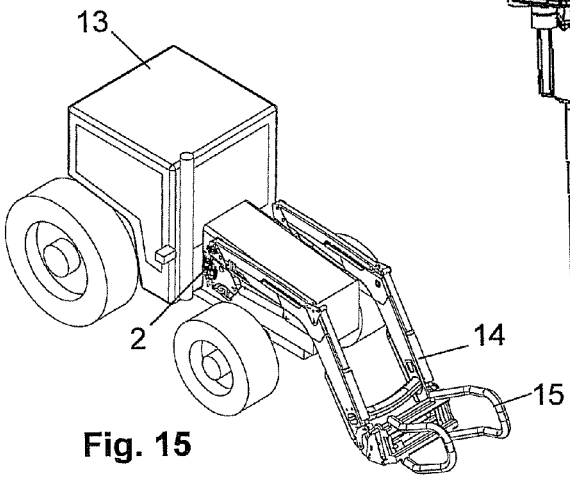

FIG. 15 schematically illustrates a perspective view of a tractor 13 with a front end loader 14 and an attached valve 2. The front end loader 14 and the tool 15 belonging to it is operated using hydraulics of the tractor via a valve 2 that is arranged at the attachment point of the front end loader 14 on the tractor 13 or on a foundation on the tractor 13. The valve connects the hydraulics of the tractor with the hydraulics of the front end loader. The invention relates to improvements associated with the valve fastening means which is used to attach the valve to the tractor.

Figure 1:
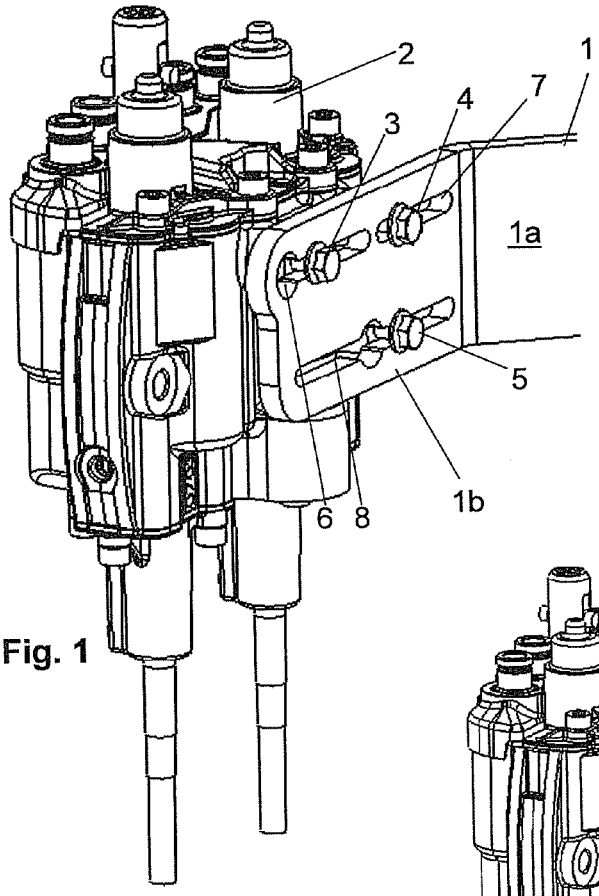

As shown in FIG. 1 the valve fastening means comprises two main parts that are put at an angle to each other. A first part, which hereinafter will be referred to as tractor part 1*a*, is intended to be attached in a suitable manner and on a suitable place on the tractor. A second part, which hereinafter will be referred to as valve part 1*b*, is adapted for attachment of a valve 2. As shown in FIG. 1, three slits 6,7 and 8 are arranged in the valve part lb and three screws 3,4 and 5 extend into the valve.

FIGS. 2-6 schematically illustrate one embodiment of a method for attaching a valve to a valve fastening means according to the present invention.

Figure 2:
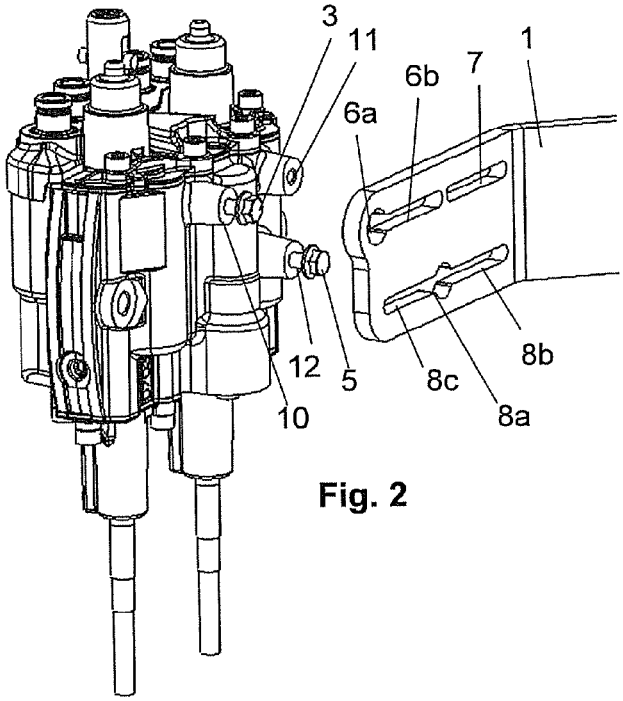

As shown in FIG. 2, the valve is provided with three screw holes 10,11 and 12, which are adapted to receive the screws 3,4 and 5. The screw holes 10 and 11 are arranged on the same height or horizontal line and the screw holes 11 and 12 are arranged on the same vertical line, whereby the three screw holes form a right-angled triangle. In FIG. 2, the valve is shown in the situation when it is going to be attached to the valve fastening means. In this situation, two screws 3 and 5 has been screw in a few turns in two of the screw holes 10 and 12, respectively. However, the screw hole 11 is empty at this stage. The slits 6 and 8 are each provided with an opening 6*a* and 8*a*, respectively. The screw heads 3 and 5 can be inserted in the openings 6*a* and 8*a*, respectively, in order to attach the valve before it is adjusted laterally and finally is fixed.

Figure 3:
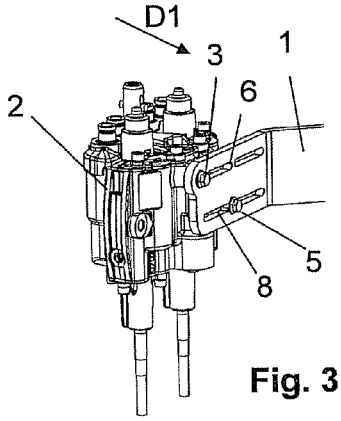
Figure 4:
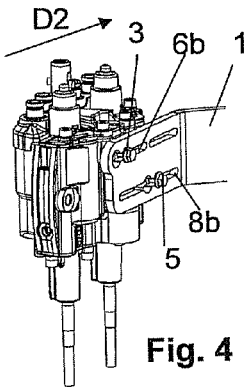

FIG. 3 schematically illustrates the valve on the valve fastening means after the screw heads 3 and 5 have been moved in the direction D1 through the openings 6*a* and 8*a* in the slits 6 and 8, respectively. Thereafter, as shown in FIG. 4, the valve can be moved in direction D2, whereby the screws are displaced from the openings 6*a* and 8*a* in the longitudinal grooves 6*b* and 8*b*, respectively.

Figure 5:
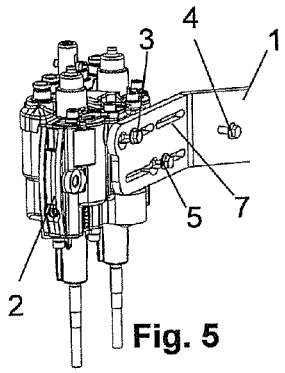

When the valve has been moved to a desired position the valve can be fixed. This is accomplished by, as shown in FIG. 5, inserting the remaining screw 4 into the hitherto empty slit 7. This slit is in the present embodiment not provided with any opening and consists of only a groove, which groove is corresponding to the grooves 6*b* and 8*b* in the slits 6 and 8, respectively. The reason to why there is no opening is that the screw 4 is intended to be screw in into the slit 7 after the valve has been attached the valve fastening means 1. Hence there is no need for any opening. Moreover, the lack of any opening in the slit 7 efficiently locks the valve in place, since the screw has to be removed in order to remove the valve 2. The slit is with advantage be displaced relatively the slits 6 and 8, in such way that the screws 3 and 5 has to be moved into their respective groove 6*b* and 8*b* in order to make the hole 11 available through the slit 7 and to make it possible to screw in the screw 4 into the hole 11 (see FIG. 2).

Figure 6:
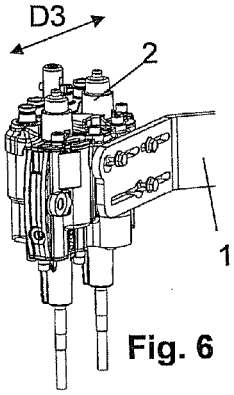

With advantage the screws 3 and 5, which only have been screw in a few turns, are screw home at the same time as the last screw 4 is tightened Thereby the valve position is fixed. Before the screws 3,4 and 5 are screw home it is, as indicated in FIG. 6, possible to laterally adjust the valve 1 in the direction D3.

FIG. 7-10 schematically illustrate a second embodiment of the valve fastening means 1 that is mirrored with regards to the valve fastening means shown in FIGS. 1-6. Also the hole pattern for the screw holes 10-12 on the valve is mirrored with regards to the valve shown in FIGS. 1-6. However, the same reference numbers are used in all figures independently of whether the structures are mirrored or not.

Figure 7:
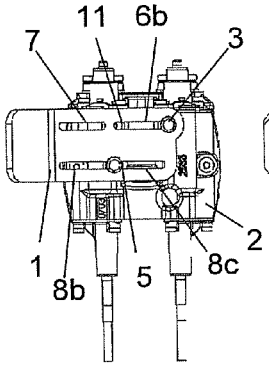
Figure 8:
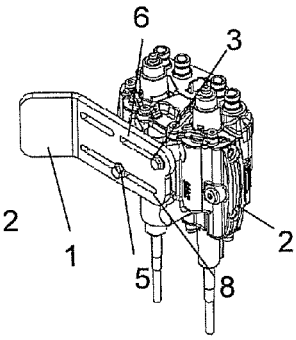
Figure 9:
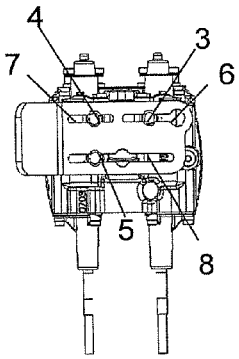
Figure 10:
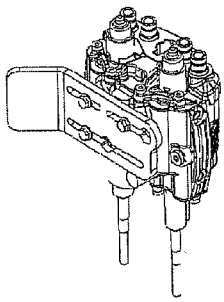
Figure 11:
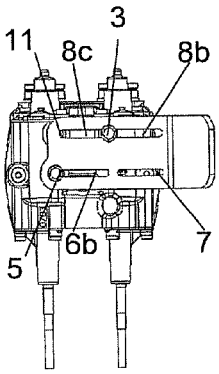
Figure 12:
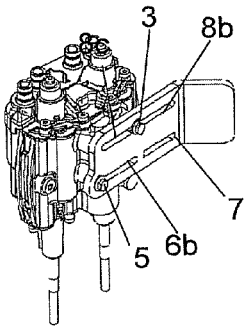

In FIGS. 7 and 8, the valve fastening means 1 and the valve are in the relative positions that correspond to the relative positions in FIG. 3, i.e. with the screws 3 and 5 in front of the openings 6*a* and 8*a*. From FIG. 7 it is appreciated that no screw hole 11 is available through the slit 7 in this position. Instead the right part of the screw hole is visible through the groove 6*b*. Thus the valve has to be moved to the left with regards to the valve fastening means, i.e. towards the position that is shown in FIGS. 9 and 10 before the screw can be inserted into the last screw hole 11.

One advantage with the valve fastening means according to the invention is that it is turnable, i.e. the valve part lb can be attached in any orientation on the tractor with maintained functionality.

FIGS. 11-14 show the second embodiment of the valve fastening means 1 arranged upside-down with regards to the arrangement in FIGS. 7-10. Thus the slit 8 is arranged in an upper part and the slits 6 and 7 are arranged below the slit 8. The screw 3, which is arranged in the screw hole 10 on the valve, is in this embodiment inserted through the opening 8*a*, while the screw 5, which is arranged in the screw hole 12, is inserted through the opening 6*a*. In accordance with the function of the valve fastening means when it is arranged in the opposite orientation (upside-down), as in FIGS. 7-10, the third screw hole 11 is covered sufficiently much not to be available as long as the screws remains in the openings 6*a* and 8*a*. However, in FIG. 11 a portion of the screw hole 11 can be observed through the left part of the groove 8*c*.

Figure 13:
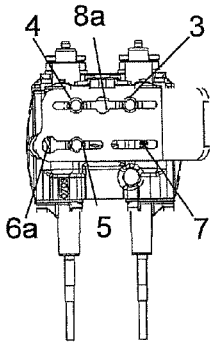
Figure 14:
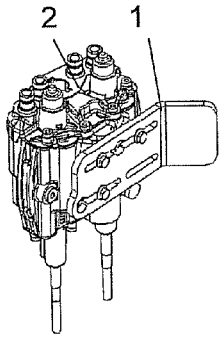

In the situation that is shown in FIGS. 13 and 14 the valve 2 has been displaced to the right with regards to the valve fastening means 1 and the third screw 4 has been screw in through a second groove 8*c* in the slit 8. Thus the slit 7 is not used at all when the valve fastening means 1 has this orientation. The function of the slit 7 is than provided by the left groove 8*c* in the slit 8.

While the invention has been described in connection with what is presently considered to be the most practical and preferred embodiments, it is to be understood that the invention is not to be limited to the disclosed embodiments, on the contrary, it is intended to cover various modifications and equivalent arrangements within the appended claims.

The invention claimed is:

1. A valve fastening means (1) for attachment of a hydraulic valve (2) on a tractor, the hydraulic valve (2) having at least two screw holes each adapted to receive a screw, the valve fastening means comprising:

a tractor part (1*a*) adapted to be attached on a tractor; and a valve part (1*b*) adapted for direct assembly of the hydraulic valve (2), the valve part (1*b*) comprising at least two slits, of which at least a first slit comprises an opening adapted to let a head of a first screw pass therethrough, and both the first slit and a second of said at least two slits comprise a groove sufficiently narrow to prevent the heads of the first screw and a second screw, respectively, from passing therethrough, but sufficiently wide to allow respective threads of the first and second screws to pass therethrough, the grooves of said at least two slits extending in the same longitudinal direction so that the hydraulic valve (2), when attached to the valve fastening means without having the first and second screws fully tightened, is movable along the grooves in such way that the first and second screws move in the respective grooves of said at least two slits, wherein the second slit is free of any opening sufficient to permit passage of the head of the second screw, the second slit being displaced from all others of the at least two slits, and wherein the second slit is displaced from respective positions of the at least two screw holes of the valve (2), whereby the second screw (4) must be screwed out in order to enable movement of the hydraulic valve (2) to a position where the first screw extending through the first slit is positioned in front of the opening of the first slit.

2. The valve fastening means (1) according to claim 1, wherein the valve fastening means (1) further comprises a third slit so as to form, in combination with the first and second slits, three slits (6,7,8), said third slit comprising an opening (6*a*,8*a*) adapted to let a head of a third screw (3,5) pass therethrough.

3. The valve fastening means (1) according to claim 2, wherein the first slit (6) and the second slit (7) are arranged one after the other in a common horizontal line, and the third slit (8) is arranged in parallel, but vertically displaced, in relation to the common horizontal line of the first and second slits (6,7), and wherein the third slit (8) also comprises a groove (6*b*,8*b*) that is sufficiently narrow to prevent the head of the third screw from passing therethrough, but sufficiently wide to allow threads of the third screw to pass therethrough, the first slit (6) and the third slit (8) extending in parallel and in the same direction in relation to their respective openings (6*a*,8*a*).

4. The valve fastening means (1) according to claim 3, wherein the third slit (8) comprises two grooves, each originating from the opening (8*a*) of the third slit (8) but extending in opposite directions, said two grooves extending in parallel in relation to the groove of the first slit (6).

5. The valve fastening means (1) according to claim 1, wherein said at least two slits are arranged relative each other in such way that the valve fastening means (1) can be attached to the tractor in two different orientations, of which one is upside-down in relation to the other, whereby the valve (2) properly oriented can be arranged on the valve fastening means (1) irrespective of the orientation of the valve fastening means (1) on the tractor.

6. The valve fastening means (1) according to claim 1, wherein the tractor part (1*a*) and the valve part (1*b*) are arranged at an angle to each other.

7. The valve fastening means (1) according to claim 2, wherein said slits (6,7,8) are arranged relative each other in such way that the valve fastening means (1) can be attached to the tractor in two different orientations, of which one is upside-down in relation to the other, whereby the valve (2) properly oriented can be arranged on the valve fastening means (1) irrespective of the orientation of the valve fastening means (1) on the tractor.

8. The valve fastening means (1) according to claim 3, wherein said slits are arranged relative each other in such way that the valve fastening means (1) can be attached to the tractor in two different orientations, of which one is upside-down in relation to the other, whereby the valve (2) properly oriented can be arranged on the valve fastening means (1) irrespective of the orientation of the valve fastening means (1) on the tractor.

9. The valve fastening means (1) according to claim 4, wherein said slits are arranged relative each other in such way that the valve fastening means (1) can be attached to the tractor in two different orientations, of which one is upside-down in relation to the other, whereby the valve (2) properly oriented can be arranged on the valve fastening means (1) irrespective of the orientation of the valve fastening means (1) on the tractor.

10. The valve fastening means (1) according to claim 2, wherein the tractor part (1*a*) and the valve part (1*b*) are arranged at an angle to each other.

11. The valve fastening means (1) according to claim 3, wherein the tractor part (1*a*) and the valve part (1*b*) are arranged at an angle to each other.

12. The valve fastening means (1) according to claim 4, wherein the tractor part (1*a*) and the valve part (1*b*) are arranged at an angle to each other.

13. The valve fastening means (1) according to claim 5, wherein the tractor part (1*a*) and the valve part (1*b*) are arranged at an angle to each other.

14. The valve fastening means (1) according to claim 1, wherein each of the first and second screws have the same dimensions.

15. The valve fastening means (1) according to claim 3, wherein each of the first, second, and third screws have the same dimensions.

16. A valve fastening means (1) for attachment of a hydraulic valve (2) on a tractor, the hydraulic valve (2) having at least two screw holes each adapted to receive a screw, the valve fastening means comprising:

a tractor part (1*a*) adapted to be attached on a tractor; and a valve part (1*b*) connected at an angle to the tractor part (1*a*), the valve part (1*b*) comprising at least two slits, of which at least a first slit comprises an opening adapted to permit a head of a first screw pass therethrough, and both the first slit and a second slit of said at least two slits comprise a groove sufficiently narrow to prevent the heads of the first screw and a second screw, respectively, from passing therethrough, but sufficiently wide to allow respective threads of the first and second screws to pass therethrough, the grooves of said at least two slits both extending in a longitudinal direction so that the hydraulic valve (2), when attached to the valve fastening means without having the first and second screws fully tightened, is movable in the longitudinal direction of the at least two slits as the first and second screws slide along respective lengths of the first and second of the at least two slits, wherein the second slit is free of any opening sufficient to permit passage of the head of the second screw, wherein the second slit is separate from and displaced from all others of the at least two slits, and wherein opposite first and second ends of the second slit are both distanced from a position of the opening of the first slit such that the second screw (4) must be entirely removed from a corresponding screw hole of the hydraulic valve (2) in order to permit the hydraulic valve (2) to occupy a position where the head of the first screw is aligned with the opening of the first slit to pass therethrough.

17. The valve fastening means (1) according to claim 16, wherein the valve fastening means (1) further comprises a third slit so as to form, in combination with the first and second slits, three slits (6,7,8), said third slit comprising an opening adapted to permit a head of a third screw to pass therethrough.

18. The valve fastening means (1) according to claim 17, wherein the first slit (6) and the second slit (7) are arranged one after the other in a common horizontal line, and the third slit (8) is arranged in parallel, but vertically displaced, with respect to the common horizontal line of the first and second slits (6,7), and wherein the third slit (8) comprises a groove (6*b*,8*b*) that is sufficiently narrow to prevent the head of the third screw from passing therethrough, but sufficiently wide to allow threads of the third screw to pass therethrough, the first slit (6) and the third slit (8) being parallel to each other and each extending from their respective openings (6*a*, 8*a*) in the same direction.

19. The valve fastening means (1) according to claim 18, wherein the third slit (8) comprises two grooves, each originating from the opening (8*a*) of the third slit (8) but extending in opposite directions, both of said two grooves extending in parallel in relation to the groove of the first slit (6).

20. The valve fastening means (1) according to claim 18, wherein each of the first, second, and third screws have the same dimensions.

* * * * *